United States Patent [19]

Bilek

[11] 4,170,422

[45] Oct. 9, 1979

[54] PRINTHEAD ALIGNMENT MECHANISM

[75] Inventor: Frank T. Bilek, Plano, Tex.

[73] Assignee: Texas Instruments Incorporated, Dallas, Tex.

[21] Appl. No.: 680,835

[22] Filed: Apr. 28, 1976

Related U.S. Application Data

[63] Continuation of Ser. No. 546,488, Feb. 3, 1975, abandoned.

[51] Int. Cl.[2] ..... B41J 3/04

[52] U.S. Cl. ..... 400/120; 400/55; 346/76 R; 400/124

[58] Field of Search ..... 197/1 R, 16, 82, 113, 197/55; 101/93.04, 93.05, 93.15; 219/216; 346/76 R

[56] References Cited

U.S. PATENT DOCUMENTS

| | | | |
|---|---|---|---|
| 3,300,017 | 1/1967 | Yazejian et al. | 197/1 R |
| 3,787,886 | 1/1974 | McCrady | 346/76 R |
| 3,845,850 | 11/1974 | Herr et al. | 197/1 R |
| 3,848,720 | 11/1974 | Carlsen | 197/1 R |
| 3,874,493 | 4/1975 | Boyd | 197/1 R |
| 3,881,587 | 5/1975 | Okabe | 197/1 R |

FOREIGN PATENT DOCUMENTS

| | | | |
|---|---|---|---|
| 2321988 | 12/1973 | Fed. Rep. of Germany | 197/1 R |

*Primary Examiner*—Ernest T. Wright, Jr.

*Attorney, Agent, or Firm*—Stephen S. Sadacca; James T. Comfort; Melvin Sharp

[57] ABSTRACT

A printhead alignment mechanism is used in a non-impact type printer, such as a thermal printer for use, typically, in an electronic calculator. The printhead may pivot in a direction around an axis that is orthogonal to the axis of rotation of the print roller over which the printing medium is driven. The printhead may also pivot in a direction around an axis parallel to the axis of rotation of the print roller. This enables the printhead to follow small irregularities in the printing medium and the print roller. Substantially even pressure is thereby applied across the printhead to provide uniform printed characters.

14 Claims, 4 Drawing Figures

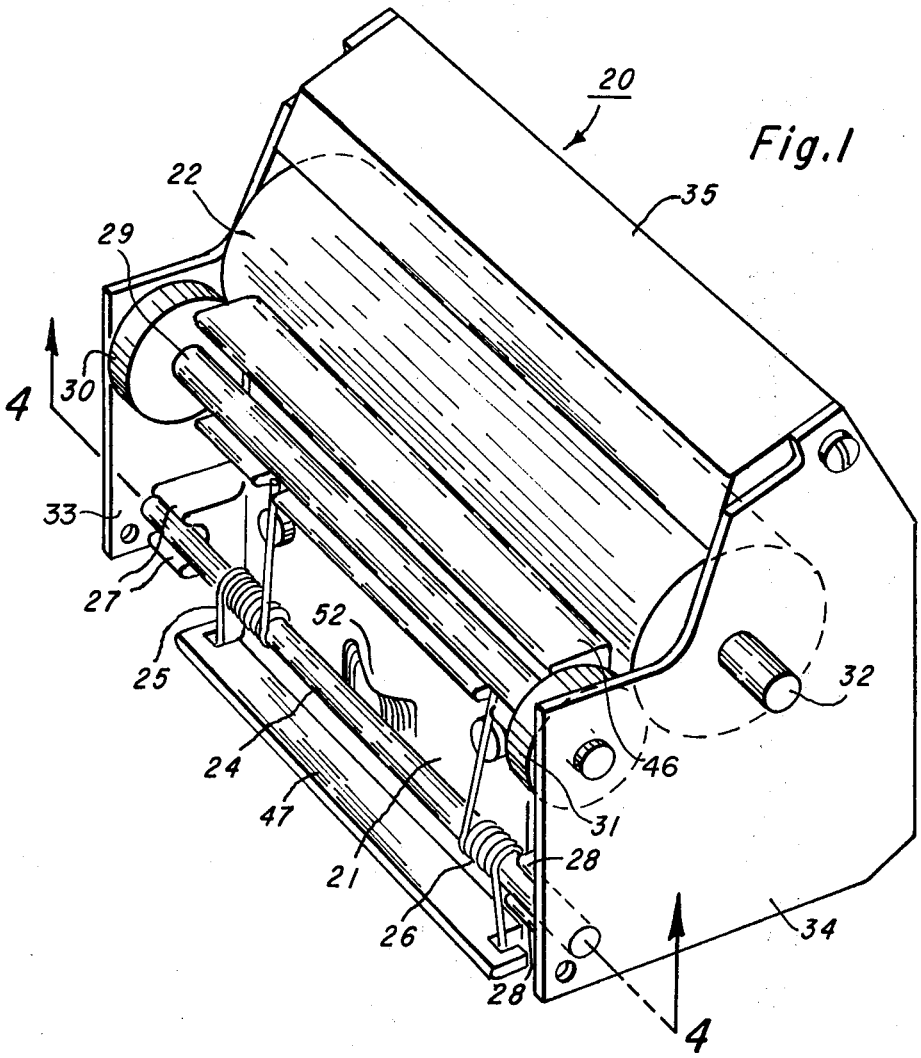
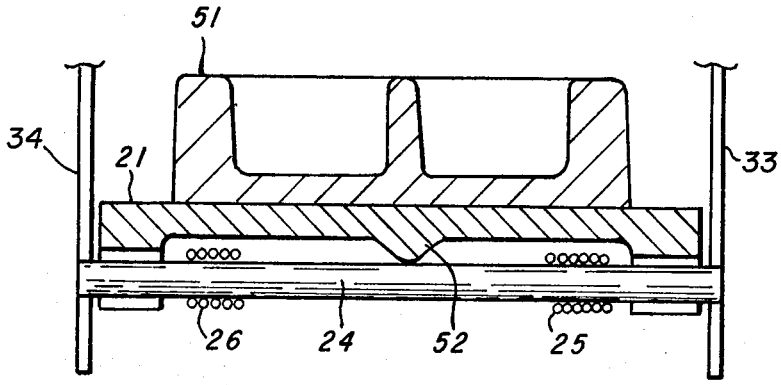
Fig. 4

45
43
35
31
26
29
52
21
24
25
47
46
50
22
30
10
33
28
20
49
51
40
41

PRINTHEAD ALIGNMENT MECHANISM

This is a continuation, of application Ser. No. 546,488, filed Feb. 3, 1975, now abandoned.

BACKGROUND OF THE INVENTION

Field of the Invention

This invention deals with non-impact type printers. More specifically, it deals with a non-impact type printer, such as a thermal printer having a printhead that is wide enough to record a plurality of characters. The relatively wide printhead must be pressed against a printing medium which is driven by a print roller. To achieve uniform print density and clarity, it is important that the pressure across the entire printhead be substantially the same.

In the prior art, non-impact type printheads have been moved across the print medium to form characters in a step-by-step fashion. The printhead required for this type of printer is generally quite small and therefore application of even pressure is a relatively simple matter. However, as the printhead is made wider, slight variations in the print roller and in the print medium may cause the printhead to fully contact one portion of the print medium and barely touch other portions.

To overcome this problem, prior art techniques have involved the very careful machining of the print roller to insure surface uniformity. This technique involves high machining costs and also requires springloaded pinch roller devices bearing against the print medium, which in turn bears against the print roller to move the print medium.

This invention permits the manufacture of a relatively cheap, resilient print roller in combination with a printhead tht is capable of pivoting around at least two axes. The resiliency of the print roller material also enables the use of stationary pinch rollers whose grasping action of the print medium is afforded by the resiliency of the roller itself, reducing the need for springloaded pinch rollers.

BRIEF SUMMARY OF THE INVENTION

In this preferred embodiment, a thermal printer is employed in an electronic calculator. This enables the calculator to provide a permanent record as differentiated from the typical electronic calculator that provides only visual readout through the use of light emitting diodes and the like. To provide a uniform and clear printout, a printhead alignment mechanism aligns the relatively wide printhead so that substantially even pressure is applied against the thermally sensitive paper. The paper is driven over a resilient print roller and the printhead is capable of pivoting around an axis that is orthogonal to the axis of rotation of the print roller, and also is able to pivot around an axis that is parallel to the axis of rotation of the print roller. In this way, the printhead is able to adjust itself to slight imperfections in the thermally sensitive paper and the print roller.

Therefore, the principal object of this invention is to provide an electronic calculator having the ability to provide a permanent record of its calculations at a speed consistent with normal operational keying speed and in clear, easy to read characters.

Another object of this invention is to provide a calculator with a nonimpact type printer with a self aligning printhead to nullify the effect of small imperfections in the print roller and the printing medium.

These and other objects will be made evident in the detailed description that follows.

BRIEF DESCRIPTION OF THE DRAWINGS

FIG. 1 is a perspective view of the non-impact printer assembly.

FIG. 4 is section 4—4 of FIG. 1.

DETAILED DESCRIPTION OF THE INVENTION

Figures 2, 3:
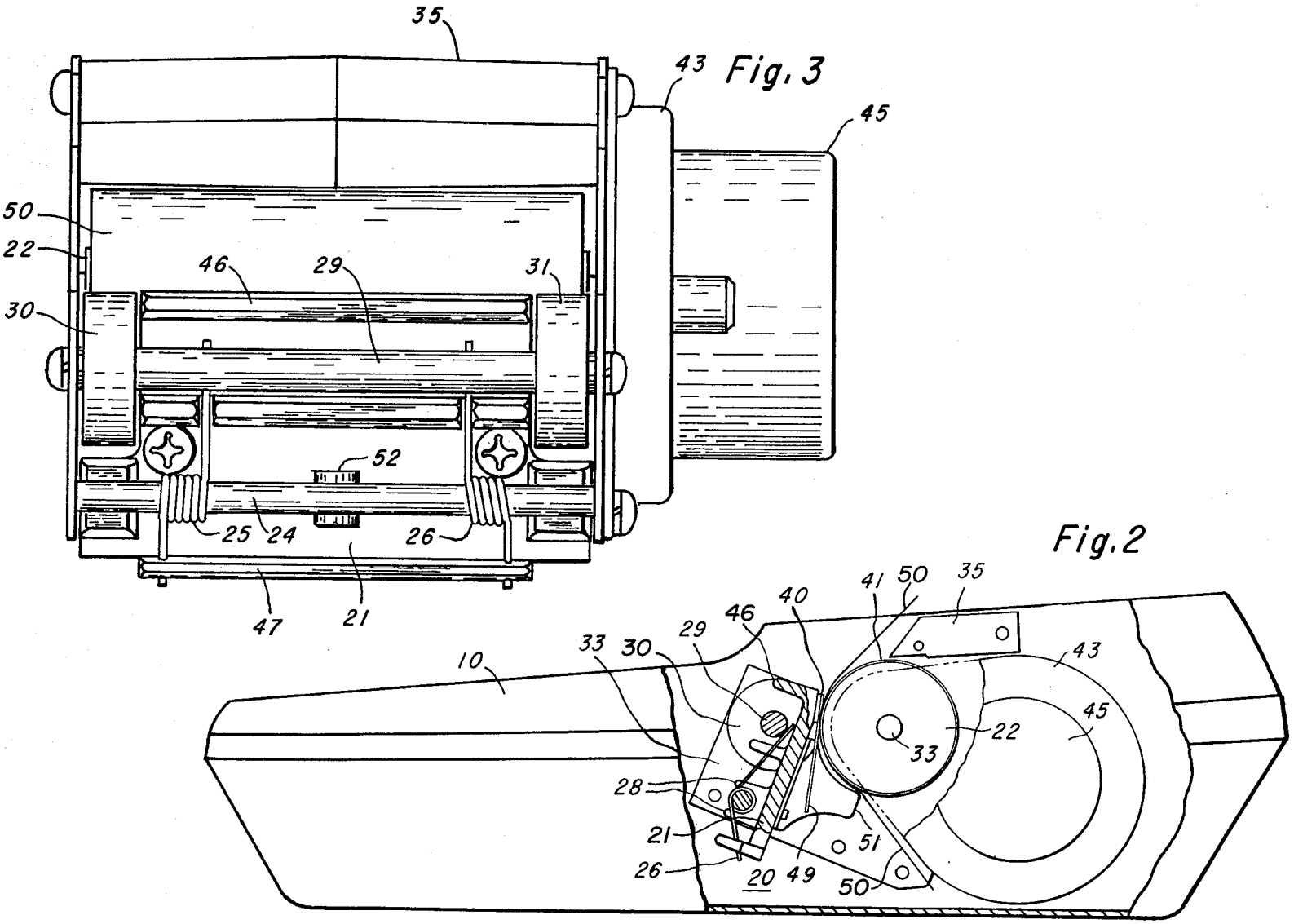
FIG. 2 is a side elevation of a typical electronic calculator in which the non-impact type printer of this invention has been incorporated.
FIG. 3 is a front elevation of the non-impact printer assembly.

FIG. 1 is a perspective of the printhead mechanism 20. Resilient print roller 22 is shown mounted on shaft 32 which is rotatably mounted between frame end pieces 33 and 34. Frame cover 35 is shown connecting the frame end pieces 33 and 34. Bracket 21 is mounted by way of bifurcated pairs 27 and 28 on mounting shaft 24. Printhead 40 (FIG. 2) is shown mounted on upper flange 46 of bracket 21. Pinch rollers 30 and 31 are shown mounted on shaft 29, which in turn is mounted between frame end pieces 33 and 34. Springs 25 and 26 are shown encircling the mounting shaft 24 with one end of each bearing against lower flange 47 of bracket 21 and the upper ends are anchored by pinch roller shaft 29. This affords a pivoting action for bracket 21 around the mounting shaft 24 as an axis.

FIG. 2 illustrates the placement of thermal print mechanism 20 within electronic calculator 10. Any electronic calculator, properly configured to receive the printer mechanism and properly electrically interfaced therewith may be employed. The particular calculator of this preferred embodiment is the Texas Instruments Incorporated TI-5050. The printer mechanism, of course, is adaptable to other calculators by either using a stand-alone case and plugging into the calculator, or configuring the calculator to receive the printer. In FIG. 2, stepping motor 45 is seen mounted in place on motor mounting bracket 43. The motor 45 is connected to cause print roller 22 to rotate. When print roller 22 rotates, thermal paper 50 is moved over head 40. Also shown are flexible conductors 49 connected to head 40 for the conduction of appropriate electrical signals.

Paper guide 51 is shown in profile and is used to guide and to partially form the paper into a stiffer configuration to avoid damage from paper movement from side to side.

Head 40, in this preferred embodiment, is made up of 60 mesas which can be selectively activated to mark the thermally sensitive paper 50. In this preferred embodiment, the mesas are separated into twelve groups of five dots each. The motor 45, which is a well known stepper motor, is used to step seven times for all characters, each time appropriate dots being selected to form a possible total of twelve characters. Each character then is formed from a five dot row, stepped seven times. This is, of course, a design choice. A head comprised of a plurality of five by seven mesa matrices could also be used. Also, the thermal printer of this invention could be an electrostatic printer, a chemical printer, or any other non-impact type printer.

FIG. 3 is a front elevation which more clearly shows the positioning of the springs 25 and 26 which are shown mounted on the mounting shaft 24 with their upper ends passed under and partially around pinch roller shaft 29. Also more clearly shown in thermally sensitive paper 50 passing over the print roller 22.

FIG. 4 is a section taken as shown in FIG. 1. Pivot projection 52 of bracket 21 is shown bearing on mounting shaft 24. If, for example, a projection occurs on the thermal paper on the left side as shown in FIG. 4, then the left side of bracket 21 will move upward, pivoting on pivot projection 52. Similarly, if a projection occurs on the right, the right side of bracket 21 will move upwardly, pivoting on pivot projection 52.

Referring again to FIG. 1, it can be seen that the bracket 21 will move away from print roller 22 when a projection occurs on it or on the thermal paper riding on it (not shown). This is done by the force exerted against head 40 and in turn against flange 46 of bracket 21 pivoting it away around its pivoting axis, mounting shaft 24.

At the same time, if the projection is off to one side, not only will the printhead 40 move back on bracket 21, but it will also pivot around the pivot projection 52.

Those skilled in the art can make superficial changes from this preferred embodiment, but contemplated by the inventor. For example, the pivot points can be moved and material selection cna be changed, all without departing from the scope and intent of this invention.

What is claimed is:

1. In a non-impact type printer having a printhead to be pressed against a recording medium, a printhead alignment mechanism comprising:

(a) a frame;

(b) a print roller, rotatably mounted on the frame for moving the print medium;

(c) a mounting shaft mounted on the frame;

(d) a bracket, to which the printhead is secured, having bearing means engaging the mounting shaft and a pivot projection, bearing against the mounting shaft, to permit pivoting in a direction around an axis that is orthogonal to the axis of rotation of the print roller; and (e) resilient means, connected to the bracket to urge the printhead toward the print roller, permitting the printhead to pivot in a direction around an axis parallel to the axis of rotation of the print roller.

2. The mechanism of claim 1 wherein the print roller is formed of a resilient material to permit pivoting of the printhead against the recording medium.

3. The mechanism of claim 1 wherein the resilient means comprise at least one spring connected to the bracket and to the mounting shaft to urge the bearing means against the mounting shaft, and to urge the printhead toward the print roller, against the printing medium.

4. The mechanism of claim 2 wherein the resilient means further comprise at least one spring connected to the bracket and to the mounting shaft to urge the bearing means against the mounting shaft and to urge the printhead toward the print roller, against the printing medium.

5. The mechanism of claim 2 wherein the bearing means comprise a pair of bifurcations, positioned at opposite sides of the bracket to engage opposite ends of the mounting shaft.

6. The mechanism of claim 4 wherein the bearing means comprise a pair of bifurcations, positioned at opposite sides of the bracket to engage opposite ends of the mounting shaft.

7. In a printer, a printhead alignment mechanism comprising a medium upon which printing is to be accomplished, printing means disposed in printing relationship to said medium, first adjustment means for adjusting the printing relationship between said printing means and said medium with respect to a first axis, second adjustment means for adjusting the printing relationship between said printing means and said medium with respect to a second axis, said second axis being at an angle to said first axis, and means for automatically adjusting said printing relationship with respect to said first and second axes to maintain said printing relationship.

8. The printhead alignment mechanism according to claim 7, wherein said first and second axes are disposed at right angles to each other.

9. The printhead alignment mechanism according to claim 1, wherein said first and second adjustment means comprise:

(a) a mounting shaft, (b) a bracket to which the printhead is secured, having bearing means engaging said mounting shaft, whereby said bracket may pivot about the axis of said mounting shaft, and a pivot projection bearing against said mounting shaft, whereby said bracket may pivot about an axis disposed at an angle to the axis of said mounting shaft, and (c) resilient means connected to said bracket to urge said bracket toward said medium, whereby said bracket is caused to pivot about an axis parallel to and an axis disposed at an angle to said mounting shaft to maintain said predetermined printing relationship.

10. The printhead alignment mechanism according to claim 9, wherein said printhead and pivot projection are each located in a fixed relation to said bracket.

11. A printhead alignment mechanism as defined in claim 9, wherein said resilient means comprises at least one spring connected to said bracket and said mounting shaft.

12. A printhead alignment mechanism as defined in claim 9, wherein said bearing means comprise a pair of bifurcations positioned at opposite sides of the bracket.

13. A printhead alignment mechanism as defined in claim 1, wherein said printing means comprise a non-impact type printer.

14. A printer according to claim 13, further including a mounting shaft whose axis coincides with said first axis, wherein said non-impact type printer remains at a predetermined location along the axis of said mounting shaft.

* * * * *